US008179248B2

(12) United States Patent
Eakle, Jr.

(10) Patent No.: US 8,179,248 B2
(45) Date of Patent: May 15, 2012

(54) DOOR LATCHING RECOGNITION APPARATUS AND PROCESS

(75) Inventor: Robert F. Eakle, Jr., New Ellenton, SC (US)

(73) Assignee: Savannah River Nuclear Solutions, LLC, Aiken, SC (US)

( * ) Notice: Subject to any disclaimer, the term of this patent is extended or adjusted under 35 U.S.C. 154(b) by 511 days.

(21) Appl. No.: 12/311,719

(22) PCT Filed: Oct. 11, 2007

(86) PCT No.: PCT/US2007/021694

§ 371 (c)(1),
(2), (4) Date: Apr. 9, 2009

(87) PCT Pub. No.: WO2008/094224

PCT Pub. Date: Aug. 7, 2008

(65) Prior Publication Data

US 2009/0261973 A1 Oct. 22, 2009

Related U.S. Application Data

(60) Provisional application No. 60/851,575, filed on Oct. 13, 2006.

(51) Int. Cl.
*G08B 23/00* (2006.01)

(52) U.S. Cl. ..... 340/528; 340/545.1; 340/545.7; 340/541; 340/542

(58) Field of Classification Search ..... 340/545.6, 340/545.7, 545.8, 545.1, 528, 542, 566, 5.64, 340/5.65, 541

See application file for complete search history.

(56) References Cited

U.S. PATENT DOCUMENTS

| | | | | |
|---|---|---|---|---|
| 4,210,900 | A * | 7/1980 | Shavit | 235/382 |
| 4,361,767 | A * | 11/1982 | Pelka et al. | 307/117 |
| 6,011,321 | A * | 1/2000 | Stancu et al. | 307/10.5 |
| 6,965,863 | B1 * | 11/2005 | Zuberec et al. | 704/270 |
| 6,989,746 | B2 * | 1/2006 | Rasmussen | 340/541 |
| 7,319,390 | B2 * | 1/2008 | Takasuka et al. | 340/541 |
| 2002/0173887 | A1 * | 11/2002 | Flick | 701/29 |

* cited by examiner

*Primary Examiner* — Hung T. Nguyen
(74) *Attorney, Agent, or Firm* — J. Bennett Mullinax, LLC

(57) ABSTRACT

An acoustic door latch detector is provided in which a sound recognition sensor is integrated into a door or door lock mechanism. The programmable sound recognition sensor can be trained to recognize the acoustic signature of the door and door lock mechanism being properly engaged and secured. The acoustic sensor will signal a first indicator indicating that proper closure was detected or sound an alarm condition if the proper acoustic signature is not detected within a predetermined time interval.

10 Claims, 3 Drawing Sheets

DOOR LATCHING RECOGNITION APPARATUS AND PROCESS

RELATED APPLICATIONS

This application claims the benefit of U.S. Provisional Application Ser. No. 60/851,575 filed on 13 Oct. 2006, and which is incorporated herein by reference.

STATEMENT AS TO RIGHTS TO INVENTIONS MADE UNDER FEDERALLY SPONSORED RESEARCH AND DEVELOPMENT

This invention was made with Government support under Contract No. DE-AC0996-SR18500 awarded by the United States Department of Energy. The Government has certain rights in the invention.

FIELD OF THE INVENTION

This invention is directed towards security systems for verifying the proper locking and latching of doors. One aspect of the invention is more particularly directed towards a door and door lock mechanism which has a pattern recognition sensor associated with the door which will recognize the sequence of sounds associated with a proper door closure and latching process and will signal an alarm condition when a proper door closure sequence is not recognized.

BACKGROUND OF THE INVENTION

There are a number of different door security systems which are known and used and which share the common goal of enhancing security. Many door locks and sensor systems make use of proximity switches, light sensors, and other technology which conveys information as to whether a door is in proper position relative to a doorframe. However, such technologies are often part of an alarm system which remains inactive during periods of normal traffic flow through a door.

Further, proximity switches indicate positioning of relative portions of a door but do not provide information on whether an actual latching sequence between a door lock mechanism and a striker plate has occurred. For instance, if a door lock is tampered with such that the latch does not operate, the proximity switch would still indicate proper operation provided the door is in proper position within a doorframe. However, a proximity indicator does not ensure that the latching sequence required for securing the door has occurred.

Despite the numerous advances in electronics, sensors, and monitoring systems, a key point of failure in door security involves human operator error and failure to physically check that a door has been properly latched. Accordingly, there remains room for improvement and variation within the art directed to door security and door closure mechanisms.

SUMMARY OF THE INVENTION

It is one aspect of at least one of the present embodiments to provide for a door lock having a sound pattern recognition sensor operatively associated with the door lock mechanism. The sound pattern recognition sensor can be programmed to recognize the unique sequences of a door engaging a doorframe including the sound and/or vibration pattern of the door bolt engaging within a conventional strike plate mounted within the door jamb as the door closes.

It is yet another aspect of at least one of the present embodiments to provide for a programmable door lock having a sensor which can be trained to recognize a unique pattern of sounds associated with proper closure of a door and engagement of the door lock.

It is yet a further aspect of at least one embodiment of the present invention to provide for a method of verifying proper closure of a door comprising providing a programmable sound recognition sensor in operative engagement with at least one of a door lock, a door, or a doorframe; programming the sensor to recognize the sequence of sounds associated with proper closure of the door; recognizing the proper sequence of sounds associated with proper engagement of a door and thereby providing a confirming signal and, upon failure to recognize the proper sequence of sounds associated with a door closure, signaling an alert signal indicating that the door may be unlatched.

It is a further aspect of at least one embodiment of the present invention to provide for a door lock and door locking process in which a monitoring mode can be initiated by one of several independent events including an acoustic event such as tampering or normal opening or shutting of the door(s), which may be detected by either a sound/vibration sensor or a mechanical event such as movement of a latch bolt, a door, or actuation of an electronic sensor such as a key card, proximity badge, or key pad, all such events resulting in a discrete electrical signal being generated to initiate the monitoring mode. Once in the monitoring mode, the sound pattern recognition sensor may be used to recognize the door specific sequences of sound and/or vibration patterns of a door being securely closed.

These and other features, aspects, and advantages of the present invention will become better understood with reference to the following description and appended claims.

BRIEF DESCRIPTION OF THE DRAWINGS

A fully enabling disclosure of the present invention, including the best mode thereof to one of ordinary skill in the art, is set forth more particularly in the remainder of the specification, including reference to the accompanying drawings.

DESCRIPTION OF THE PREFERRED EMBODIMENT

Reference will now be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents. Other objects, features, and aspects of the present invention are disclosed in the following detailed description. It is to be understood by one of ordinary skill in the art that the present discussion is a description of exemplary embodiments only and is not intended as limiting the broader aspects of the present invention, which broader aspects are embodied in the exemplary constructions.

In describing the various figures herein, the same reference numbers are used throughout to describe the same material, apparatus, or process pathway. To avoid redundancy, detailed descriptions of much of the apparatus once described in relation to a figure is not repeated in the descriptions of subsequent figures, although such apparatus or process is labeled with the same reference numbers.

An exemplary embodiment of the present invention uses an acoustic sensor which is mounted within one of either a door handle/lock assembly, within a door, within a doorframe, or in an otherwise operative engagement with a door including placement within the vicinity of a door or doorframe such that the acoustic sensor may detect sounds and/or vibrations associated with the normal closure and/or locking of a door. The present invention is compatible with any conventional door closure and/or locking hardware. The components of a door handle and door locking system while well known to one having ordinary skill in the art, reference may be made to U.S. Pat. Nos. 6,912,882 and 6,941,778, the specifications of which are incorporated herein by reference, for purposes of describing the components of a conventional door lock. The present invention is also compatible with electronic locks including locks which are designed for operation using key card systems as taught in U.S. Pat. No. 7,051,561 which is incorporated herein by reference.

Figure 1:
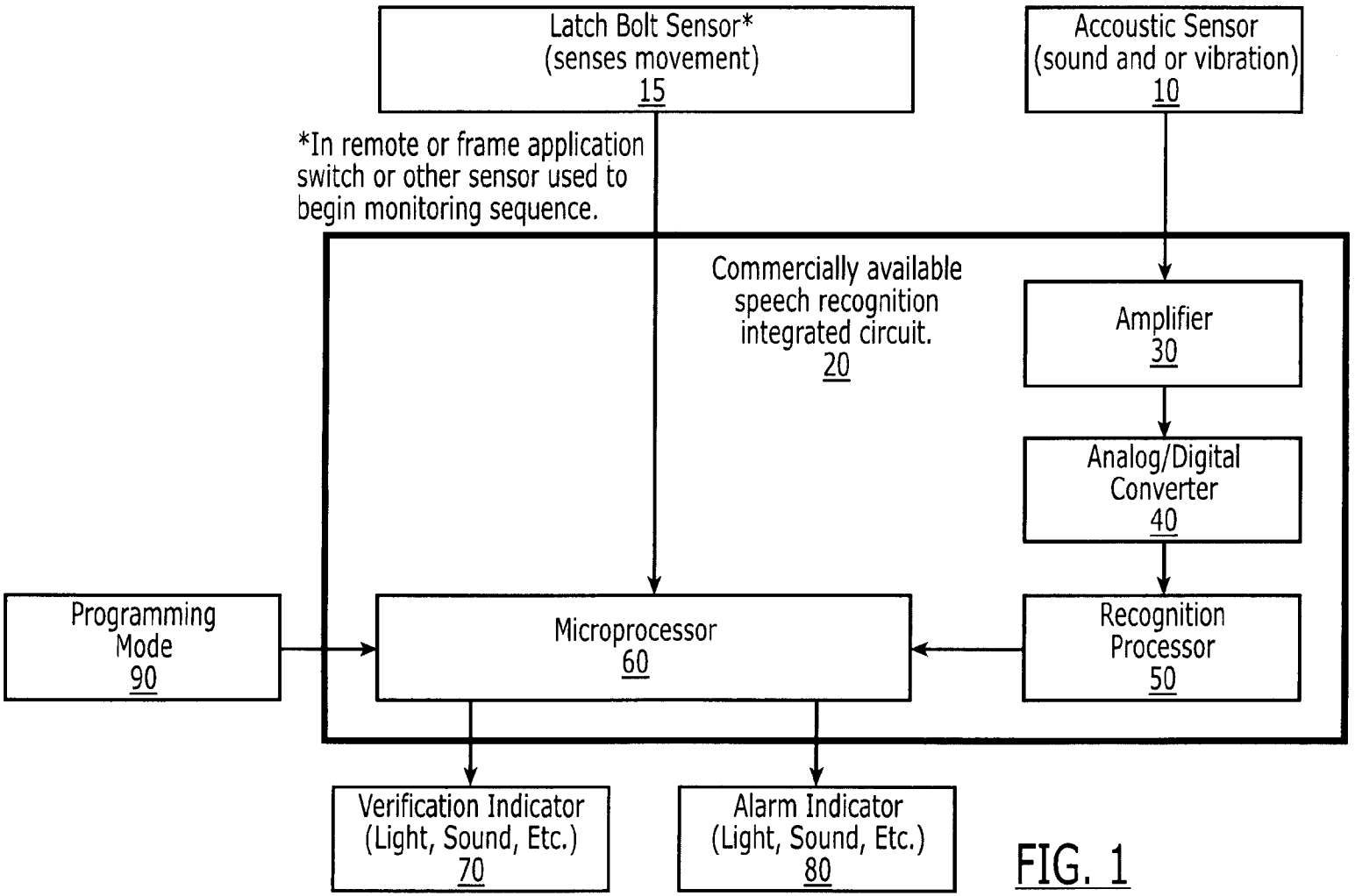
FIG. 1 is a schematic diagram indicating the steps and components associated with an automatic door latch detector.

As seen in reference to FIG. 1, the acoustic sensor 10 transmits its signal to a sound recognition sensor 20 such as a sound recognition sensor commercially available from Sensory, Inc. (Santa Clara, Calif.). The design of other sound and/or speech recognition sensors suitable for use in the present invention may be seen in reference to U.S. Pat. No. 5,774,841 which disclosures a speech and sound recognition apparatus along with U.S. Pat. No. 6,965,863 directed to speech recognition controllers. In addition, U.S. Pat. No. 6,637,267 uses a sound recognition circuit as part of a sound-based fault identification system. The teachings and specifications of U.S. Pat. Nos. 5,774,841, 6,965,863, and 6,637,267 are incorporated herein by reference and are reflective of the skill level in the appropriate fields of one having ordinary skill in the art.

The sound recognition sensor 20 includes an amplifier 30 for receiving a signal from the acoustic sensor 10. The amplifier 30 then transmits the signal through an analog/digital converter 40 into a recognition processor 50 which is controlled by a microprocessor 60. The recognition processor 50, in association with the microprocessor 60, will provide either a verification signal 70 which may be used to activate a light or sound if the door closure sequence matches a programmed recognition of sounds or may be used to activate an alarm indicator 80 to indicate a possible failure of the door to properly latch.

The closure of a door generates a sequence of recognizable vibrations and sounds. The sound recognition sensor 20 can be trained for any individual door to recognize a range of normal door closure and lock engagement sounds and vibrations and thereafter discriminate between a proper door closure sequence from an improper sequence. Acoustic sensor 10 includes a programming mode function 90 which allows the sound recognition sensor 20 to recognize the proper sequence of sounds associated with a door closing/latching operation. Once programmed, any deviation from the recognized sound patterns may be used to signal an alarm indicator 80 to alert the user or area security personnel that the door failed to properly close and/or latch.

Figure 2:
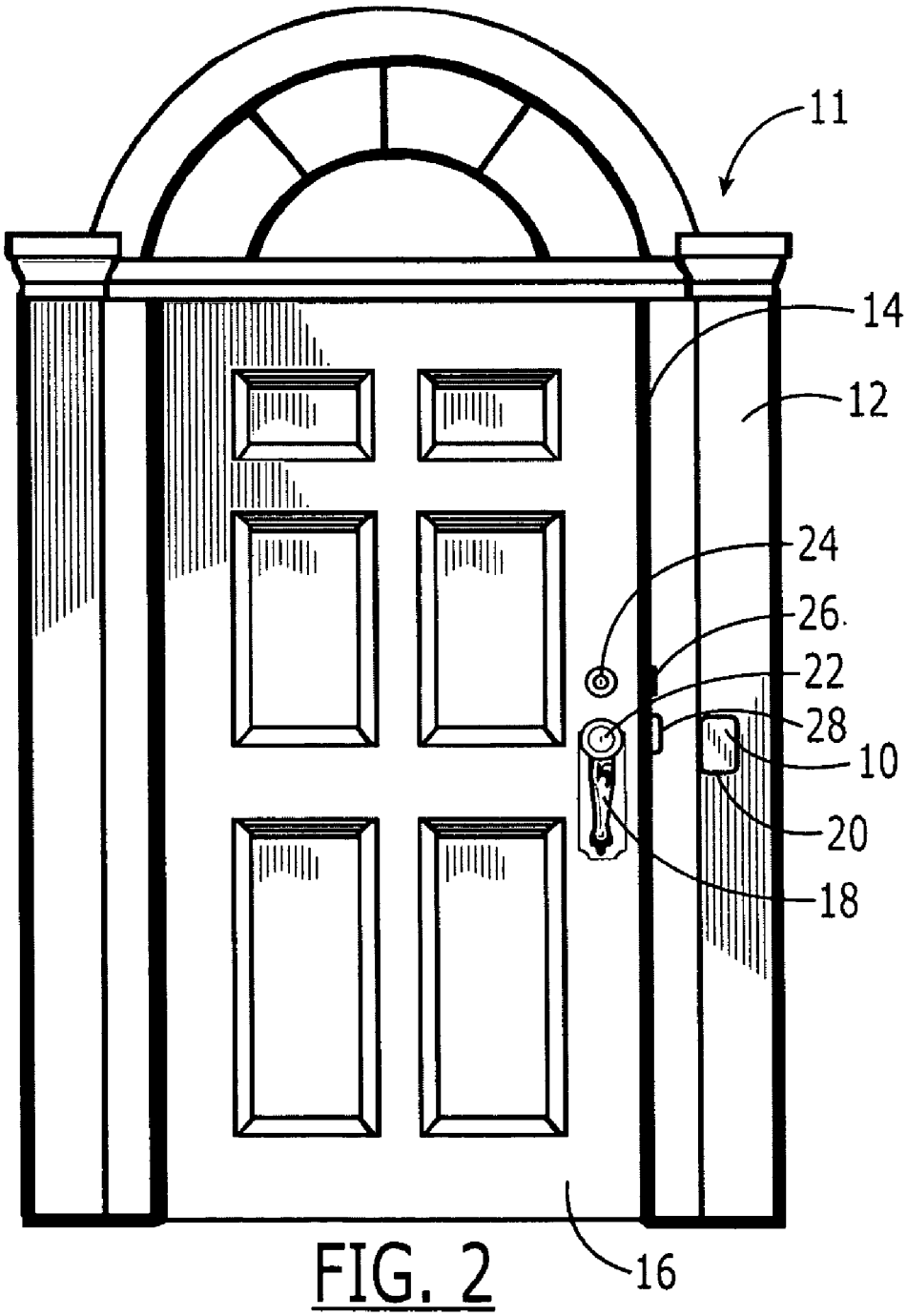
FIG. 2 is a front elevation view of a door illustrating aspects of the present invention.

As seen in reference to FIG. 2, a representative entry or exit doorway 11 is provided. The doorway comprises a door 16 having a handle 18 which may optionally have either a handle lock 22 and/or a separate deadbolt lock 24. Where a handle lock 22 is provided, a strike plate 28 is associated with the corresponding latch of lock 22. Similarly, for deadbolt 24 there is a latch mechanism 26 for engagement of a bolt member associated with deadbolt lock 24. As illustrated, a sound recognition sensor 20 may be present anywhere along a doorway 11. As seen in FIG. 2, sound recognition sensor 20 may share a common housing with an acoustic sensor 10. Alternatively, acoustic sensor 10 and/or a sound recognition sensor 20 may be positioned within an internal cavity associated with a door, a doorframe, door molding, or within the door handle or door locking mechanism. For ease of illustration, the acoustic sensor 10 and sound recognition sensor 20 are depicted on an exterior portion of the doorway 11.

As depicted in FIG. 2, acoustic sensor 10 is in proximity to doorway 11 and may be placed on a support member 12 associated with doorway 11 or placed on a portion of doorframe 14 which also receives the strike plate 28. It is also envisioned that the acoustic sensor 10 could be placed on the door 16 or integrated into a portion of the door handle 18. Acoustic sensor 10 may be placed anywhere in proximity to doorway 11 where it may receive acoustic or vibrational patterns associated with the normal opening and closing operations of the door 16.

By incorporating the sound recognition sensor as part of a door lock or door closure system, an additional safeguard against human error and/or tampering with respect to door closures may be placed in operation. Individuals entering or exiting the door may be trained to recognize the door latching signal indicating that proper engagement of the door lock has occurred. While conventional security guidelines suggest that existing best practices for verifying proper locking and engagement of a door involves a human operator manually testing the door, this protocol is frequently ignored or overlooked. The present invention provides for an audible and/or other recognizable signal to the door operator that can provide verification that proper latching sequence of the bolt through properly engaging the strike plate has occurred. Similarly, should the sound recognition sensor not detect the proper sequence, an immediate alarm condition can sound prompting the operator to again check/shut the door and/or investigate reasons why the door has not properly latched.

The acoustic sensor 10 used to interface with the sound recognition sensor 20 can be selected to recognize sequential sounds and/or vibration patterns such as those generated by the striking of the bolt against the strike plate 28 followed by the sound of the bolt engaging the receptacle defined by an opening in the strike plate and the door jamb. The process of door opening and closing can be seen in reference to FIGS. 3A through 3E.

Figure 3C:
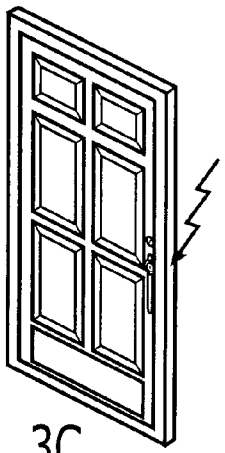
FIGS. 3A through 3E set forth sequences of door closure events indicating the operation of the acoustic door latch detector and the sequence of a normal door closure operation.
Figure 3B:
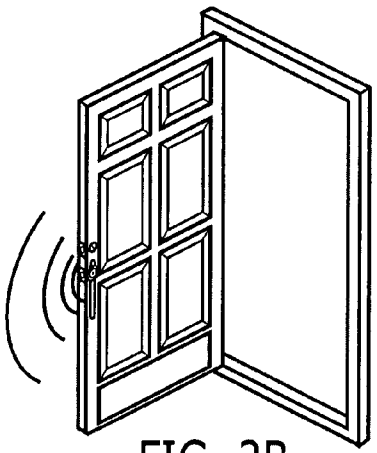
Figure 3A:
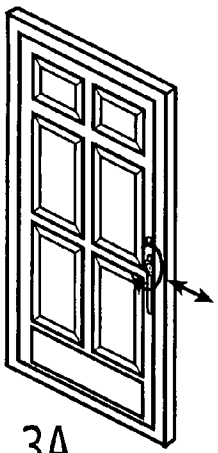
Figure 3E:
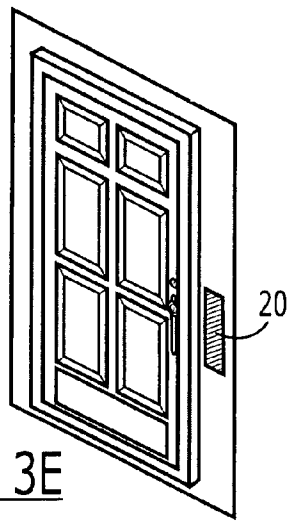

As seen in FIG. 3A, movement of the door lock mechanism such as the handle latch, bolt movement, or other triggering mechanisms which sense movement can activate the microprocessor 60 and the sound recognition sensor 20. A typical programming mode would include activating an alarm event if the acoustic sensor 10 did not subsequently detect within a predetermined time interval proper closure of the door. The door latching recognition apparatus addresses a common security concern where authorized individuals may attempt to prop open and/or block the operation of a door latch temporarily to allow more convenient access to a building. Such security breaches afford opportunities for unauthorized people to gain access into the building. The present invention would generate an alarm event as soon as the normal closure operation or hardware are tampered with.

As set forth in FIG. 3C, the normal shutting of the door generates an acoustic sound wave or other vibration which is picked up by the acoustic sensor 10 and processed through sensor 20. The sensor 20 will recognize a door latch acoustic/vibrational signature once the signature has been programmed into the sensor 20. As see in reference to FIG. 1, if the sound recognition sensor 20 recognizes proper closure of the door, a verification signal 70 in the form of light, sound, or other indicia can be used to signal proper closure. If the sound recognition sensor 20 fails to recognize a proper sequence or intensity of sounds/vibrations, an alarm indicator 80 may sound indicating that the door is not properly secured.

Figure 3D:
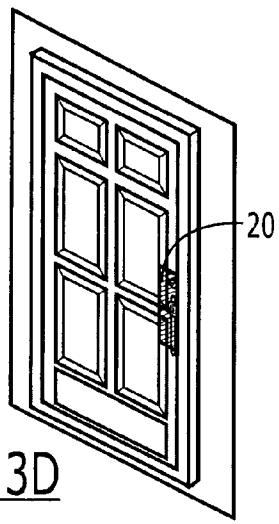

As seen in reference to FIG. 3D, the sensor 10 may be included as part of the door locking hardware positioned on either an exterior surface of the door or positioned within a housing within an interior of the door.

The sound recognition sensor 20 may be present in a door frame or other location remote from the door. The pattern recognition can involve both sounds and vibrations and therefore is less prone to interference that may be caused by individual's voices or other sounds occurring in proximity to the door. It is believed that the accuracy with which the acoustic door sensor can detect proper closure is such that alarm conditions, including a small number of false alarm conditions caused by auditory interference such as voices, sirens, aircraft, and other transient but commonly encountered background noises, will maintain a high level of awareness of operators to verify door closure upon receiving an alarm condition. The acoustic door monitoring system can also detect if a door has been tampered with such as an obstruction within the bolt through hole since such tampering will alter the recognized acoustic door closure pattern.

The electronics associated with the acoustic sensor 10 and the sound recognition sensor 20 may be operated by any conventional power source. For instance, a lithium long life battery is useful in powering the electronics and provides a useful capacity, long shelf life, and a compact size. However, in some applications there may be present a battery back up system while the electronics are powered by AC or DC current which may be used to operate other components of a door security system such as monitoring sensors or electronic blocks.

To further conserve battery life, it is envisioned that the sound recognition system is normally in a powered down mode. However, a separate sensor 15 (FIG. 1) that detects movement of the door can power up the sound recognition sensor 20 for a predetermined interval in which the sensor will "listen" for a proper door closing sequence. If the proper sequence is not determined within a selectable time interval, such as 5 seconds, an alarm condition indicator will go off. Alternatively, a conventional key card, proximity badge, or key pad code system can all be used to initiate the sound recognition sensor 20. In addition, it is envisioned that in all alarm conditions, the alarm indicator can be transmitted to a remote monitoring location or panel.

While a variety of acoustic sensors may be employed to interface with the sound recognition sensor 20, it has been found that Pizo electric pickups work well in the door operating environment. The ability of the acoustic sensor and the sound recognition sensor to recognize a programmable recognition sequence is important in that there may exist significant variations in the sounds associated with the proper latching and engagement of a lock within a strike plate positioned within a door jamb. For instance, even when all the locking hardware is identical, the nature and quality of the door such as metal, wood, or synthetic, the surrounding wall materials, and whether an interior of the door is insulated or otherwise reinforced, will affect the acoustic signature associated with proper door latching. Likewise, should there be any modifications, maintenance or replacement of door or door lock components, it may be necessary to reprogram the sound recognition sensor in view of the changed acoustic signature associated with the sounds of the proper door lock engagement.

As seen in reference to FIG. 1, the sound recognition sensor may be provided with a "training" function which, when activated, will place the sound recognition sensor in a "programming" mode during which time the acoustics/vibrations encountered during the brief learning interval will be stored for later recognition. Upon subsequent verification that the learning mode operation was indicative of the normal door closing sequence, the apparatus will thereafter provide a signal of proper door engagement and also indicate alarm conditions when the proper sequence is not detected.

The advantages of the apparatus and monitoring process are numerous. One, the apparatus and process overcomes shortcomings of proximity switches which may indicate a door is positioned within a doorframe, but does not sufficiently place such that the locking enclosure mechanisms are engaged. The present apparatus and process will alert a user and/or a monitoring location if a door fails to properly latch. The apparatus and process are also suitable for use with key card and other controlled access systems. If desired, the activation of a proximity card or badge can serve to activate the microprocessor in a manner analogous to a physical movement such as a latch bolt sensor 15. The programming mode could also include a necessary recognition sequence of an audible sound signature of an accepted key card acknowledgment tone or the signal tone generated from a key pad password entry system.

The present apparatus and system also lends itself to having two or more recognition systems established in its programming mode which can be time dependent. For instance, during normal business activities, a first programming mode would recognize the sounds of a door closure and latch vibrations for signaling proper closure. A second programming mode could have a second recognition pattern for after hours which would require a different acoustic signature such as the additional step of engaging and operating a deadbolt key lock, for example. Alternatively, the additional sequence may include the recognition tone of a key card placed on an appropriate audible tone generator and recognition pad so as to further identify or establish the identity of an individual entering or leaving the premises.

An additional advantage of the present apparatus and process is that efforts to tamper with the door so as to later gain unauthorized access would be immediately detected since efforts to prevent engagement of a door bolt within a strike plate, for example, would sufficiently alter the established recognition sound patterns such that an alarm event would be actuated. Similarly, efforts to enter a door by stealth and closing the door in a manner to minimize any sounds would also trigger an alarm event.

Although preferred embodiments of the invention have been described using specific terms, devices, and methods, such description is for illustrative purposes only. The words used are words of description rather than of limitation. It is to be understood that changes and variations may be made by those of ordinary skill in the art without departing from the spirit or the scope of the present invention which is set forth in the following claims. In addition, it should be understood that aspects of the various embodiments may be interchanged, both in whole, or in part. Therefore, the spirit and scope of the appended claims should not be limited to the description of the preferred versions contained therein.

That which is claimed:

1. An apparatus for detecting closure of a door comprising:

an acoustic sensor in operative engagement with at least one of a door, a door frame, a door lock, or a door handle;

a programmable sound recognition sensor in communication with said acoustic sensor, said sound recognition sensor recognizing the acoustic signal associated with the normal and locking patterns of a door;

a first indicator signal responsive to said sound recognition sensor when a recognized sequence of a door closure has occurred within a predetermined time interval; and, a second indicator signal responsive to said sound recognition sensor, said second indicator signal being activated when said recognized sequence is not detected within a predetermined time interval.

2. A process of monitoring closure of a door comprising:

providing an acoustic sensor positioned upon at least one of a door, a door frame, a door molding, a door lock, or a door handle;

providing a sound recognition sensor in communication with said acoustic sensor, said sound recognition sensor being programmable and recognizing the acoustic signature associated with the desired closing and locking pattern of a door;

activating said sound recognition sensor when a door is opened;

providing a detection interval for which said sound recognition sensor may recognize said acoustic signature; and, signaling following said time interval either a first indicator that an acoustic signal was detected or a second indicator that an acoustic signal was not detected, thereby alerting individuals in proximity to said door a status of the door and lock engagement condition.

3. The apparatus according to claim 1 wherein said acoustic sensor is positioned at a location remote from said programmable sound recognition sensor.

4. The apparatus according to claim 1 wherein said acoustic sensor is positioned within a common housing with said programmable sound recognition sensor.

5. The apparatus according to claim 1 wherein said apparatus further includes a motion sensor for detecting movement of at least one of a door, a door handle, or a door lock.

6. The process of monitoring closure of a door according to claim 2 wherein said process includes an additional step of sensing movement of at least one of a door, a door lock, or a door handle, said movement being communicated to said sound recognition sensor.

7. The process according to claim 2 wherein said sound recognition sensor may store multiple acoustic signatures, recognition of said signatures being selectable upon a predetermined level of desired security.

8. The apparatus according to claim 1 wherein said sound recognition sensor is in further communication with at least one of a proximity badge detector or a key pad entry code system.

9. The process according to claim 2 wherein said step of activating said sound recognition sensor further includes said sound recognition sensor receiving a signal from a proximity badge reader, or a key pad entry code apparatus, thereby activating said sound recognition sensor prior to said door being opened.

10. The process according to claim 2 wherein said acoustic signature may include an audible tone generated from a proximity badge reader or key card system.

* * * * *